US006944997B2

(12) United States Patent
Verkamp

(10) Patent No.: US 6,944,997 B2
(45) Date of Patent: Sep. 20, 2005

(54) SPACER FOR RETROFITTING CORRUGATED METAL ROOFS

(76) Inventor: Mark J. Verkamp, 10824 Hwy. 217, Charlesten, AK (US) 72933

( * ) Notice: Subject to any disclaimer, the term of this patent is extended or adjusted under 35 U.S.C. 154(b) by 214 days.

(21) Appl. No.: 10/636,813

(22) Filed: Aug. 8, 2003

(65) Prior Publication Data

US 2005/0028470 A1 Feb. 10, 2005

(51) Int. Cl.[7] ..... E04C 1/00

(52) U.S. Cl. ..... 52/309.4; 52/309.5; 52/309.9; 52/DIG. 15; 52/748.1; 428/40.1; 428/158; 428/159; 428/160

(58) Field of Search ..... 52/309.4, 309.5, 52/309.12, 309.9, 309.8, 309.6, 309.1, 592.1, 90.2, 408, 410, 409, 551, DIG. 15, 748.1; 428/40.1, 158, 159, 160

(56) References Cited

U.S. PATENT DOCUMENTS

| | | | | | |
|---|---|---|---|---|---|
| 1,986,999 | A | * | 1/1935 | Burgess | 52/336 |
| 2,931,212 | A | | 4/1960 | Wiesmann | |
| 3,482,367 | A | | 12/1969 | Curran | |
| 3,662,509 | A | | 5/1972 | Studzinski | |
| 4,295,304 | A | * | 10/1981 | Kim | 52/91.1 |
| 4,335,557 | A | * | 6/1982 | Morton | 52/745.05 |
| 4,403,980 | A | * | 9/1983 | Simpson et al. | 52/309.11 |
| 4,571,909 | A | | 2/1986 | Berhuis et al. | |
| 5,600,929 | A | * | 2/1997 | Morris | 52/309.8 |
| 5,826,383 | A | | 10/1998 | Garrison | |
| 5,842,315 | A | * | 12/1998 | Lin | 52/309.9 |
| 5,927,032 | A | * | 7/1999 | Record | 52/309.11 |
| 6,247,281 | B1 | * | 6/2001 | Lin | 52/309.4 |
| 6,418,678 | B2 | * | 7/2002 | Rotter | 52/199 |
| 6,418,686 | B1 | * | 7/2002 | Record | 52/309.15 |
| 2003/0033769 | A1 | | 2/2003 | Record | |

FOREIGN PATENT DOCUMENTS

| | | |
|---|---|---|
| JP | 9209529 | 8/1997 |

* cited by examiner

*Primary Examiner*—Carl D. Friedman
*Assistant Examiner*—Chi Q. Nguyen
(74) *Attorney, Agent, or Firm*—Stephen R. Greiner

(57) ABSTRACT

A spacer for retrofitting corrugated metal roofs. The spacer includes a foam block having a notched bottom for receiving the corrugations of a metal roof. The opposite ends of the foam block are respectively provided with tongue and groove fittings. An adhesive layer is applied to the bottom surface of the foam block for securing the foam block to the metal roof. A high-density foam strip is affixed to the top of the foam block for supporting a corrugated, metal panel above.

5 Claims, 1 Drawing Sheet

SPACER FOR RETROFITTING CORRUGATED METAL ROOFS

FIELD OF THE INVENTION

The present invention relates generally to static structures and, more particularly, to such structures with synthetic, resinous components.

BACKGROUND OF THE INVENTION

Although metal roofs are known for their durability and long lives, they do corrode over time and require periodic replacement. Replacing a metal roof is a major undertaking that typically requires a major investment in terms of manpower and time. Traditionally, an old roof was painstakingly torn off a building and hauled away before a new roof was added, exposing the occupants of the affected building to the weather. To reduce time and cost, roofers have more recently taken to leaving an old roof in place and installing a new roof directly atop the old roof.

Different manufacturers provide metal roofing materials with different surface contours or corrugations. Hundreds of profiles are currently available and are variously touted for their abilities to shed precipitation and to withstand deformation under load. Since it is difficult to match the profiles of a new roofing material to an old one, some roofers attach horizontal rows of boards to the top of an old metal roof prior to installing a new roof. These boards position the new roofing materials a fixed distance above the old ones so that surface contours of the old and new roofing materials do not have to match. Unfortunately, wooden boards tend to warp over time causing new roofs to buckle and leak. Additionally, because the boards are substantially rigid, stepping on a new roof at any point away from the boards can cause a permanent bend or crease in the new roofing materials.

SUMMARY OF THE INVENTION

In light of the problems associated with the known methods and apparatus for installing new metal roofs atop old ones, it is a principal object of the present invention to provide a spacer for retrofitting corrugated metal roofs formed with synthetic, resinous components. After installation, the spacer yields somewhat to minimize the likelihood of damage to a new metal roof in the event that the roof is placed under a localized load such as when someone walks upon the roof.

It is another object of the present invention to provide a spacer of the type described that is self-adhesive and easy to install, requiring minimal training and no special tools to accomplish the task. The spacer is configured to snugly engage in old corrugated metal roof and, also, to interlock with adjacent spacers so as to form an elongated chain that is easy to manipulate during the installation process.

It is a further object of the present invention to provide a spacer of the type described that is itself an effective insulator and that provides an insulating air gap between an old metal roof and a new one. If desired, conventional building insulation can be provided between rows of spacers to provide a fully insulated roof.

It is an object of the invention to provide improved elements and arrangements thereof in a spacer for the purposes described which is lightweight in construction, inexpensive to manufacture, and fully dependable in use.

Briefly, the spacer in accordance with this invention achieves the intended objects by featuring an elongated foam block having a bottom surface that is notched to receive the raised edges found on a metal roof. An adhesive, covered with a release liner prior to use, is applied to the bottom surface for securing the foam block upon a roof. The top surface of the foam block is flat and carries a high-density foam strip for supporting a corrugated roofing panel above. The ends of the foam block are respectively provided with tongue and groove fittings so that a number of blocks can be locked together to form a chain.

The foregoing and other objects, features and advantages of the present invention will become readily apparent upon further review of the following detailed description of the preferred embodiment as illustrated in the accompanying drawings.

BRIEF DESCRIPTION OF THE DRAWINGS

The present invention may be more readily described with reference to the accompanying drawings, in which.

Similar reference characters denote corresponding features consistently throughout the accompanying drawings.

DETAILED DESCRIPTION OF THE PREFERRED EMBODIMENT

Figure 1:
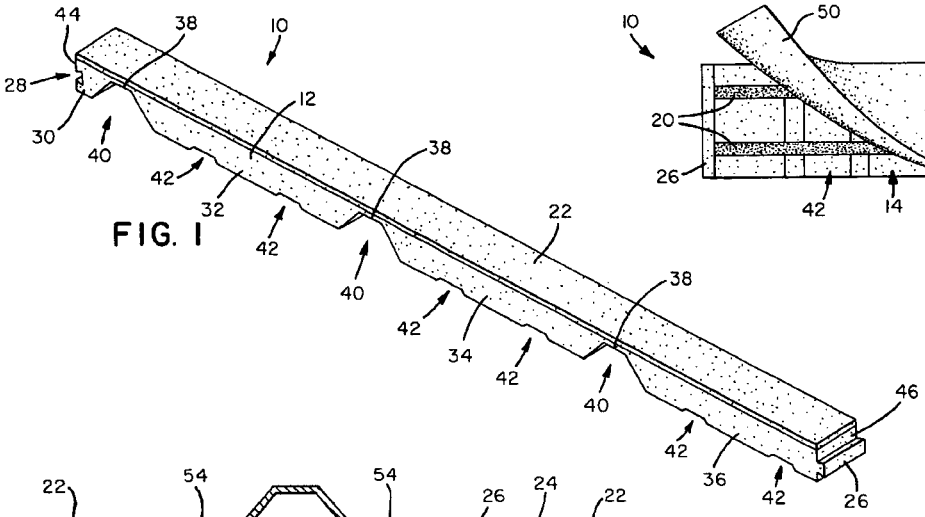
FIG. 1 is a perspective view of a spacer in accordance with the present invention.
Figure 3:
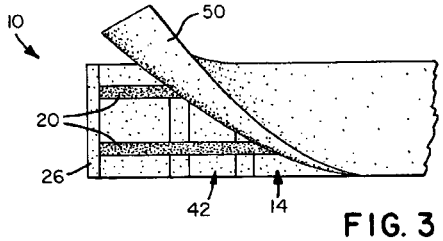
FIG. 3 is a bottom view of one end of the spacer with its release liner being partially removed to show the adhesive that the release liner protects.

Referring now to the FIGS., a spacer in accordance with the present invention is shown at 10. Spacer 10 includes an elongated, foam block 12 having a bottom surface 14 that is notched to receive the corrugations 16 of an old, metal roofing panel 18. A pair of adhesive strips 20 is applied to bottom surface 14 for securing foam block 12 upon roofing panel 18. The top of foam block 12 carries a high-density foam strip 22 for supporting a new, corrugated, metal, roofing panel 24 above. The ends of foam block 12 are respectively provided with tongue and groove fittings 26 and 28 so that a plurality of spacers 10 can be locked together in a chain for easy installation.

Block 12 includes four ribs 30, 32, 34 and 36 joined at their tops by integral straps 38. Ribs 30–34 are separated by principal notches 40 in block 12 that are more than one half the height of block 12. The bottoms of ribs 32, 34 and 36, however, are each provided with a pair of spaced apart, secondary notches 42 that are less than one half the height of block 12. Principal and secondary notches 40 and 42 snugly receive corrugations 16 of corresponding shape in panel 18.

Figure 2:
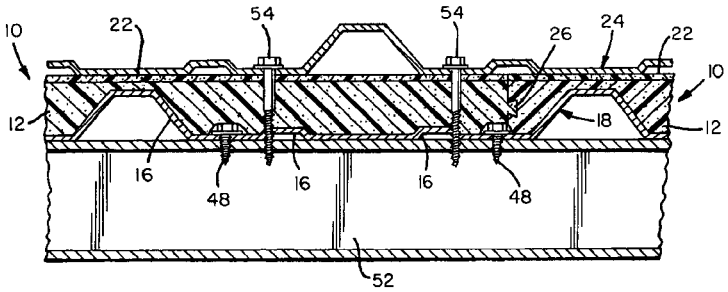
FIG. 2 is a cross-sectional view of a retrofit roof with the mated end portions of a pair of spacers as shown in FIG. 1 separating upper and lower, corrugated, roofing panels.

Vertical end walls 44 and 46 define the outer sides of end ribs 30 and 36. A tongue fitting 26, narrower at its inner side than at its outer side, projects outwardly from end wall 46 and extends from the front to the back of block 12. A groove fitting 28, narrower at its outer side than at its inner side, is provided within end wall 44 and is adapted to snugly receive a tongue fitting 26 of a second block 10 as shown in FIG. 2. When mated together by means of interlocked tongue and groove fittings 26 and 28, end ribs 30 and 36 form a structure whose configuration is substantially like that of interior ribs 32 and 34.

Adhesively affixed to the top of block 12 is high-density foam strip 22. Strip 22 extends across the length and width of block 12. Strip 22 is greater than twice as dense as block 12 having a density of 9 lbs. per cubic foot whereas the block 12 is a density of 4 lbs. per cubic foot. The high-density of strip 22 increases the durability and stiffness of spacer 10 and permits loads from panel 24 to be more evenly distributed through block 12 to panel 18. The low density of block 12 reduces the overall weight of spacer 10 and offers a resiliency that permits ribs 30–36 to conform to uneven surfaces of panel 18 and even to accept the upwardly projecting heads of threaded fasteners 48 extending from panel 18.

Two beads of adhesive cement 20 are applied to the bottom of block 12 that provide a means for attaching block 12 to roofing panel 18. Cement 20 extends from one end of block 12 to the other, fully traversing ribs 30–36 and straps 38 and entering notches 40 and 42. Cement 20 is preferably a nontoxic, contact-type glue that, if desired, may be pulled from panel 18 while leaving little or no residue on panel 18 thereby permitting block 12 to be repositioned as needed during installation thereof.

A removable release liner 50 covers adhesive cement 20 in order to keep such from becoming contaminated prior to use. Release liner 50 is formed of paper having at least one surface treated as with silicone for ready detachment from cement 20. Of course, release liner 50 is retained on adhesive cement 20 until a user detaches it while spacer 10 is made ready for use.

The use of spacers 10 is straightforward. First, a roof comprising many panels 18 position side-by-side is measured to determine its width. Then, a sufficient number of spacers 10 are linked together by engaging the tongue fitting 26 of one spacer 10 with the groove fitting 28 of another spacer 10 so as to form a chain that will span the measured width. Next, release liners 50 are removed from the bottoms of spacers 10 to expose adhesive cement 20. Now, the chain of spacers 10 is positioned atop the roof at a desired location and is pressed downwardly to adhere spacers 10 to the roof. The process is repeated until the roof is provided with a number of chains of spacers 10 distanced from one another at intervals sufficient to support metal panels 24 above without substantial deformation of panels 24 under expected loads this distance may be the same as that provided between the purlins 52 supporting roofing panel 18. Finally, threaded fasteners 54 are driven downwardly through metal panels 24 and 18 and spacers 10 to secure metal panels 24 to a building structure. When the roof is fully covered with metal panels 24, the effort is complete. At no time during the process were building occupants exposed to the weather nor were panels 24 damaged by roofers walking upon them as often happens when rigid spacers are used with metal roofs.

While the invention has been described with a high degree of particularity, it will be appreciated by those skilled in the art that modifications may be made thereto. For example, the configuration of ribs 30–36 and notches 40 and 42 maybe varied to accommodate roofing panels 18 with different corrugations patterns of which many are known. Therefore, it is to be understood that the present invention is not limited to the sole embodiment described above, but encompasses any and all embodiments within the scope of the following claims.

I claim:

1. A spacer for retrofitting corrugated metal roofs, comprising:

a foam block having opposed ends and having a notched bottom for receiving the corrugations of a metal roof, and the ends of said foam block being respectively provided with tongue and groove fittings;

an adhesive layer applied to said bottom surface for securing said foam block to the metal roof;

a high-density foam strip affixed to the top of said foam block for supporting a corrugated, metal panel above.

2. The spacer according to claim 1 wherein said block includes a plurality of ribs joined at their tops by integral straps, and wherein the space beneath each of said straps defines a principal notch in said block having a height greater than one half the height of said block, and the bottoms of said ribs each being provided with at least one secondary notch having a height less than one half the height of said block.

3. The spacer according to claim 1 further comprising a removable release liner covering said adhesive layer in order to keep such from becoming contaminated prior to use.

4. The spacer according to claim 1 wherein said high-density foam strip is at least twice as dense as said foam block.

5. A spacer for retrofitting corrugated metal roofs, comprising:

a foam block having opposed ends and having a notched bottom for receiving the corrugations of a metal roof, and the ends of said foam block being respectively provided with tongue and groove fittings;

adhesive cement applied to said bottom surface for securing said foam block to the metal roof;

a release liner covering said adhesive cement; and, a high-density foam strip affixed to the top of said foam block for supporting a corrugated, metal panel above.

* * * * *